US007854670B2

(12) United States Patent
Gait

(10) Patent No.: US 7,854,670 B2
(45) **Date of Patent: *Dec. 21, 2010**

(54) PREFORMED LACROSSE POCKET AND PACKAGING FOR SAME

(75) Inventor: Paul Gait, Altamont, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/030,075

(22) Filed: Feb. 12, 2008

(65) Prior Publication Data

US 2008/0127615 A1 Jun. 5, 2008

Related U.S. Application Data

(60) Continuation of application No. 11/859,897, filed on Sep. 24, 2007, now Pat. No. 7,458,908, which is a division of application No. 11/222,410, filed on Sep. 8, 2005, now Pat. No. 7,338,396.

(51) Int. Cl.
*A63B 59/02* (2006.01)
*A63B 65/12* (2006.01)

(52) U.S. Cl. ..... 473/513

(58) Field of Classification Search ..... 473/513, 473/512, 505; D21/724
See application file for complete search history.

(56) References Cited

U.S. PATENT DOCUMENTS

| | | | | |
|---|---|---|---|---|
| 733,542 | A | 7/1903 | Converse | |
| 2,142,527 | A | 1/1939 | Pool | |
| 2,670,958 | A | 3/1954 | Leiser et al. | |
| 2,749,555 | A | 6/1956 | Oliveira | |
| 3,741,505 | A | 6/1973 | Engel | |
| 3,905,088 | A | 9/1975 | Tucker et al. | |
| 4,037,841 | A | 7/1977 | Lewis, Jr. | |
| 4,049,273 | A | 9/1977 | Pool | |
| 4,138,111 | A | 2/1979 | Rule | |
| 4,153,251 | A | 5/1979 | Pond | |
| 4,270,756 | A | 6/1981 | Ahlenfeld et al. | |
| 4,657,260 | A | 4/1987 | Brine, Jr. | |
| 4,739,883 | A * | 4/1988 | Mohs et al. | 206/470 |
| 5,048,843 | A | 9/1991 | Dorfi et al. | |
| 5,174,580 | A | 12/1992 | Pratt | |
| 5,178,397 | A | 1/1993 | Brine, Jr. | |

(Continued)

OTHER PUBLICATIONS

Webpage download, Stringingkit, Jan. 14, 2005, www.sportsunlimitedinc.com/stringingkit.html, 3 pages.*

(Continued)

*Primary Examiner*—Gene Kim
*Assistant Examiner*—M Chambers
(74) *Attorney, Agent, or Firm*—Waddy & Patterson, P.C.; Phillip E. Walker

(57) ABSTRACT

Included herein is a pocket for a lacrosse head. The lacrosse head includes a scoop, a throat, first and second sides, a front and a back. The pocket comprises a mesh material preformed to a desired shape so that when the pocket is placed on a stick, the location of the deepest or bulbous portion will be at an optimal location and a channel may also be formed. The mesh material is preformed using a mold and/or a heat source. A package is provided to maintain the shape of the pocket during shipment and inventory.

17 Claims, 6 Drawing Sheets

U.S. PATENT DOCUMENTS

| | | | | |
|---|---|---|---|---|
| 5,269,532 | A | 12/1993 | Tucker et al. | |
| 5,425,541 | A | 6/1995 | Ambros | |
| 5,568,925 | A | 10/1996 | Morrow et al. | |
| 5,651,549 | A | 7/1997 | Dill et al. | |
| 5,935,026 | A | 8/1999 | Dill | |
| 5,938,550 | A | 8/1999 | Hexemer et al. | |
| 6,065,589 | A * | 5/2000 | Ouwens | 206/6.1 |
| 6,066,056 | A | 5/2000 | Morrow | |
| 6,447,410 | B2 | 9/2002 | Crawford | |
| 6,506,132 | B1 | 1/2003 | Brine et al. | |
| 6,520,875 | B1 | 2/2003 | Crawford | |
| 6,561,932 | B2 | 5/2003 | Morrow | |
| 6,926,628 | B2 | 8/2005 | Morrow et al. | |
| 7,192,369 | B2 | 3/2007 | Morrow | |
| 7,458,908 | B1 * | 12/2008 | Gait | 473/513 |

OTHER PUBLICATIONS

ProTech Products, Inc., Product Page, 2002, Webpage Download, http://www.protechproductsinc.com, 3 Pages.

Plastic & Metal Center, Inc. (PMC) Product Page, 2003, Webpage Download, http:plastic-metal.com/productshowcase.htm, 2 Pages.

* cited by examiner

PREFORMED LACROSSE POCKET AND PACKAGING FOR SAME

This application is a continuation of U.S. application Ser. No. 11/859,897, which has evolved into U.S. Pat. No. 7,458,908, filed Sep. 24, 2007 entitled "Preformed Lacrosse Pocket and Packaging for Same", which is a divisional application of U.S. application Ser. No. 11/222,410, which has evolved into U.S. Pat. No. 7,338,396, filed Sep. 8, 2005 entitled "Preformed Lacrosse Pocket and Packaging for Same", both of which are hereby incorporated by reference in their entireties.

I, Paul Gait, a citizen of Canada, residing at 5 Normandy Dr., Altamont, N.Y. 12009; have invented a new and useful "Preformed Lacrosse Pocket and Packaging for Same."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or disclosed herein are hereby incorporated by reference in their entirety.

BACKGROUND OF THE INVENTION

The present invention relates generally to lacrosse equipment. More specifically the present invention relates to an improved lacrosse pocket for a lacrosse head. The improvements include the pocket being preformed during manufacture to create the ideal low point or sweet spot when the pocket is attached to a lacrosse head and packaging for the pocket that maintains the shape of the pocket during transportation and inventory.

It will be appreciated by those of ordinary skill in the art that lacrosse is a fast-growing sport. It will further be appreciated that lacrosse sticks are essential to playing the game. A lacrosse stick is comprised of a handle portion attached to a head. The lacrosse head forms a frame for a lacrosse pocket. The combined lacrosse head and pocket amount to a collection, catching, or basket type element. The lacrosse head is made using plastics and polymers such as DuPont Xytl brand nylon. The lacrosse head includes an open, or upper, side for catching and discharging a lacrosse ball and a lower side to which a net or pocket is attached for holding the ball and is used to impart the force upon the ball in order to shoot or pass the ball. A lacrosse head generally has a throat section that includes a ball stop for impacting a ball and a socket for receiving the handle. A pair of sidewalls is attached to the throat section proximate to the ball stop and are joined distal from the throat section by a lip or scoop section.

Traditionally, a pocket for a lacrosse head is hand assembled by a player using two or more cross members, or strings, with two or more longitudinal members, or runners. The runners and strings work together to form a pocket and are secured to the frame of the head using a combination of the runners, the cross pieces, and ties that attach to the cross pieces and the frame of the lacrosse head. Additionally, a lacrosse pocket can include other lateral members spanning the distance between the sides of the lacrosse head. These lateral members, which are often called shooting strings, are used to adjust the depth and tension within the pocket and allow a particular player to customize the lacrosse head to their preferred shooting style and technique.

Another type of pocket is a newer pocket made of mesh. Machine woven nylon mesh is pre-manufactured and later attached to the sidewalls, scoop and inside throat areas. The mesh pockets consist of a polyester or nylon material woven together to create a diamond mesh (much like a mesh gymnastic bag). This mesh material is machine made and is the integral body of the pocket. This mesh usually has diamond-shaped holes separating the string-like portions. The mesh is then tied to the lower side of the head using separate strings.

Prior to attachment to a head, the prior art mesh is flat. The user then must the form the pocket. Unfortunately, most players do not know how to string their own heads much less form their own pocket. Teams usually have a stick doctor who has some knowledge of how to attach the pocket and to form the pocket. Formation of the pocket is very important. Most players like the deepest part of the pocket forward of the head closer to the scoop or lip. As a result, the mesh must be tied properly to allow the deepest or bulbous part of the pocket to be placeable forward in the head. Further, a user must use some mechanism such as stuffing a ball in the pocket or a specific pocket forming stretcher to create the depth at the correct place. As a result, even if the stick owner can attach the pocket properly, the owner must wait a period of time before the pocket is formed. Not only is this uncomfortable for an impatient player, the difficulty can cause players to become frustrated.

The following U.S. patent generally describe the art of lacrosse sticks and heads, and are expressly incorporated herein by reference: U.S. Pat. Nos. 6,561,932; 6,066,056; 5,938,550; 5,935,026; 5,651,549; 5,568,925; 5,425,541; 5,178,397; 5,048,843; 4,657,260; 4,270,756; 4,138,111; 4,049,273; and 4,037,841.

What is needed is a lacrosse mesh pocket that is preformed so that the deepest part of the pocket and the overall shape of a pocket preset so that when the user attaches the pocket to a head, the deepest part of the pocket resides in the correct place. This pocket should be capable of maintaining the original shape. This pocket must be shippable and storable in this preset shape. This need pocket must be capable of mass production. This needed pocket must also be shippable in the desired shape using a package. The needed package must be usable as a form placeable in the pocket on a head. The needed pocket must be held in place during molding. This needed pocket must be held in place during shipping. This needed pocket is presently lacking in the art.

BRIEF SUMMARY OF THE INVENTION

Included herein is a pocket for a lacrosse head. The lacrosse head includes a scoop, a throat, first and second sides, a front and a back. The pocket comprises a mesh material preformed to a desired shape so that when the pocket is placed on a stick, the location of the deepest or bulbous portion will be at an optimal location and a channel may also be formed. The mesh material is preformed using a mold and/or a heat source. The mold may be provided with pins to hold the mesh in place. A package is provided to maintain the shape of the pocket during shipment and inventory. The package may be provided with tabs and grooves to hold the pocket in place.

It is therefore a general object of the present invention to provide an improved lacrosse head.

Another object of the present invention is to provide an improved lacrosse pocket for a lacrosse head.

Still another object of the present invention is to provide a lacrosse pocket having a preformed shape.

Yet another object of the present invention is to provide a lacrosse pocket that can be easily string to place the deepest part of the pocket in the optimal position by even a novice.

Another object of the present invention is to provide a lacrosse pocket that can be transported and inventoried in such a way as to maintain the desired shape.

Yet still another object of the present invention is to provide a lacrosse pocket that is easy and inexpensive to manufacture and ship.

Other objects, features, and advantages of the present invention will be readily apparent to those skilled in the art upon reading the following disclosure when taken in conjunction with the accompanying drawings.

DETAILED DESCRIPTION OF THE INVENTION

Figure 1:
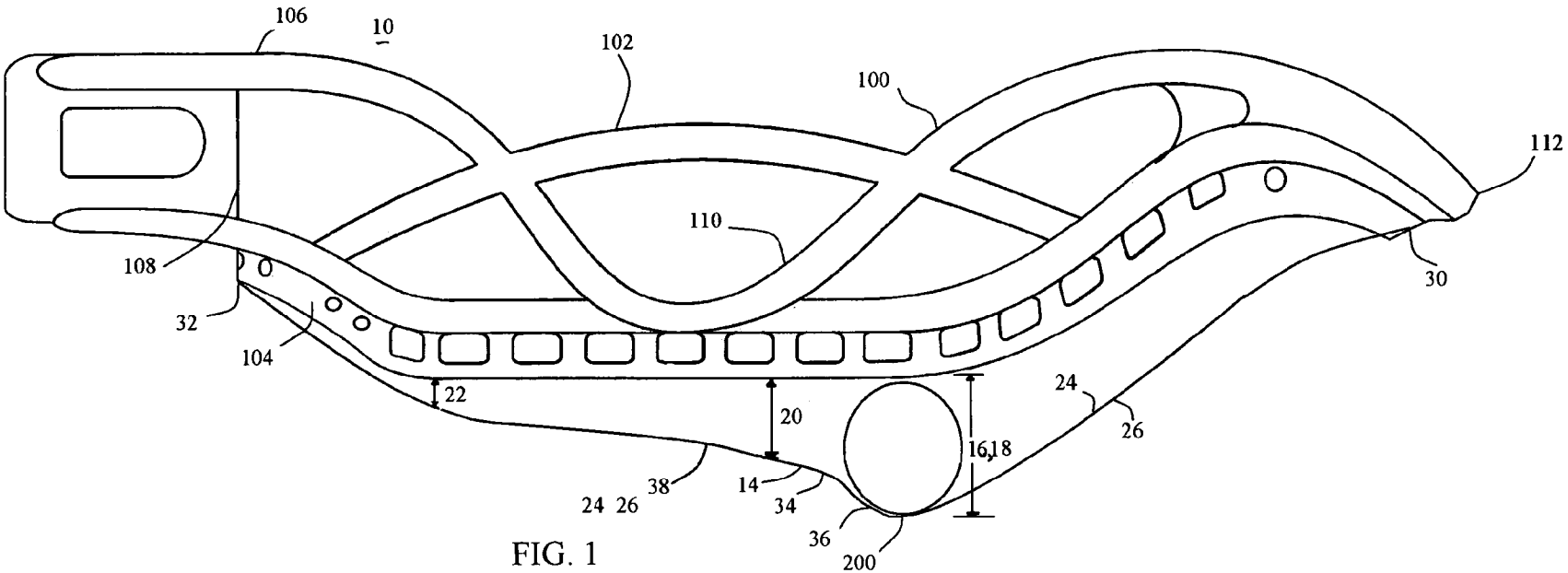
FIG. 1 is a side view of an embodiment of the pocket attached to a lacrosse head.
Figure 2:
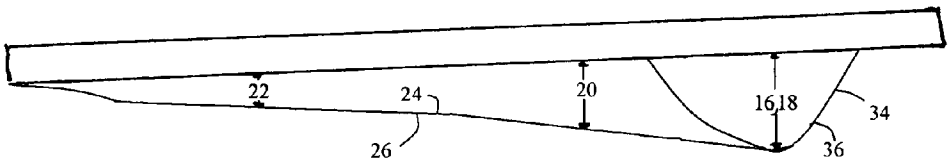
FIG. 2 is a side view of the pocket.
Figure 3:
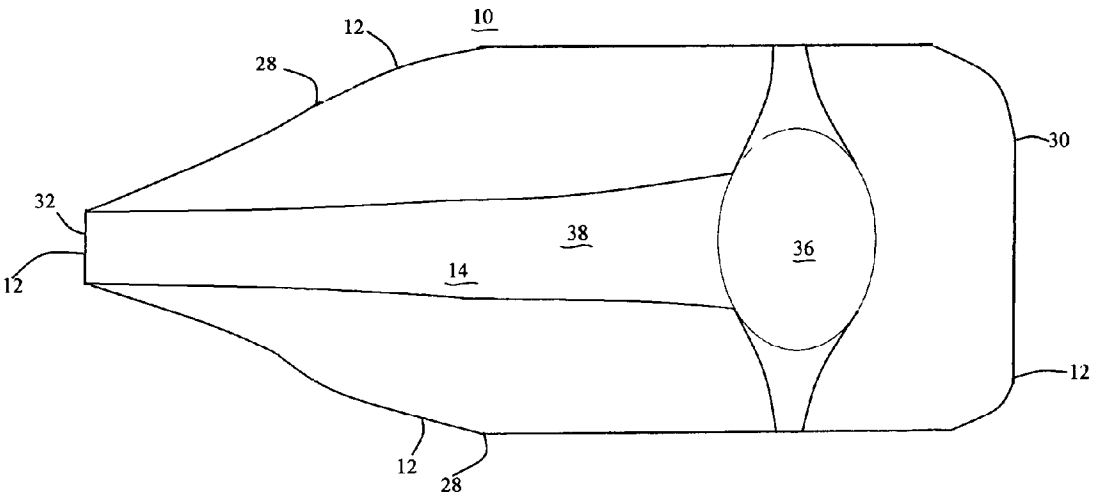
FIG. 3 is a plan view of the pocket.

Referring generally now to FIGS. 1-3 there is shown generally at 10 the lacrosse pocket of the present invention. The lacrosse pocket 10 attaches to a lacrosse head 100. The lacrosse head 100 has an open or upper side 102 and a lower or closed side 104. The head 100 has a throat 106 joined to a lip or scoop 112 by sidewalls 110. Proximal throat 106 there is placed a ball stop 108. The lacrosse pocket 10 preferably attached to the lower side 104 of the head 10 but may be attached to any other attachment portion of the head.

In the preferred embodiment, the pocket is a mesh material that may be formed to a desired shape 34 using pressure and/or heat. The preformed pocket 10 has edges 12 surrounding an interior portion 14. The edges 12 can include a leading or forward edge 30, a trailing or rear edge 22, and one or more side edges 28 (preferably two or more). The pocket 10 also has an upper face 24 and a lower face 26. The desired shape 34 is created by a depth 16 formed into the pocket 10 between the upper most portion of the upper face 24 and the lowermost portion of the lower face 26. Depth 16 can be placed at any point on pocket 10 so for reference forward depth 18, middle depth 20, and rear depth 22 will be discussed.

Most players like to place the deepest portion of the pocket or the sweet spot 36 forward in the head 100. As a result, the preferred embodiment of the head 10 of the present invention places the bulbous area or region 36 proximal forward depth 18. In this embodiment, forward depth 18 is greater than middle depth 20 which is greater than rearward depth 22. The location of bulbous area 36 proximal forward depth 18 creates channel 38 from the trailing edge 32 toward the leading edge 30. As the deepest part of the pocket 10 will attract the ball 200, the ball 200 will trend toward the bulbous portion 36. The pocket 10 may also be provided with a channel 38 to direct the ball 200 into the bulbous portion 36.

Figure 4:
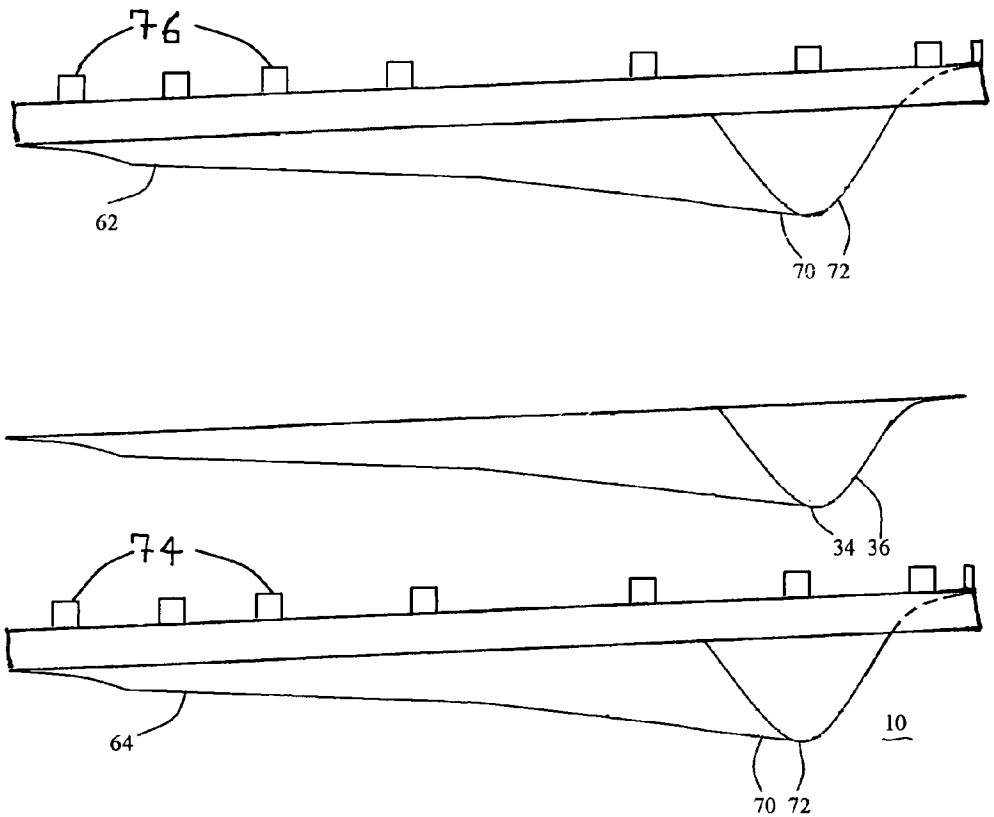
FIG. 4 is an exploded view of the pocket and package.
Figure 5:
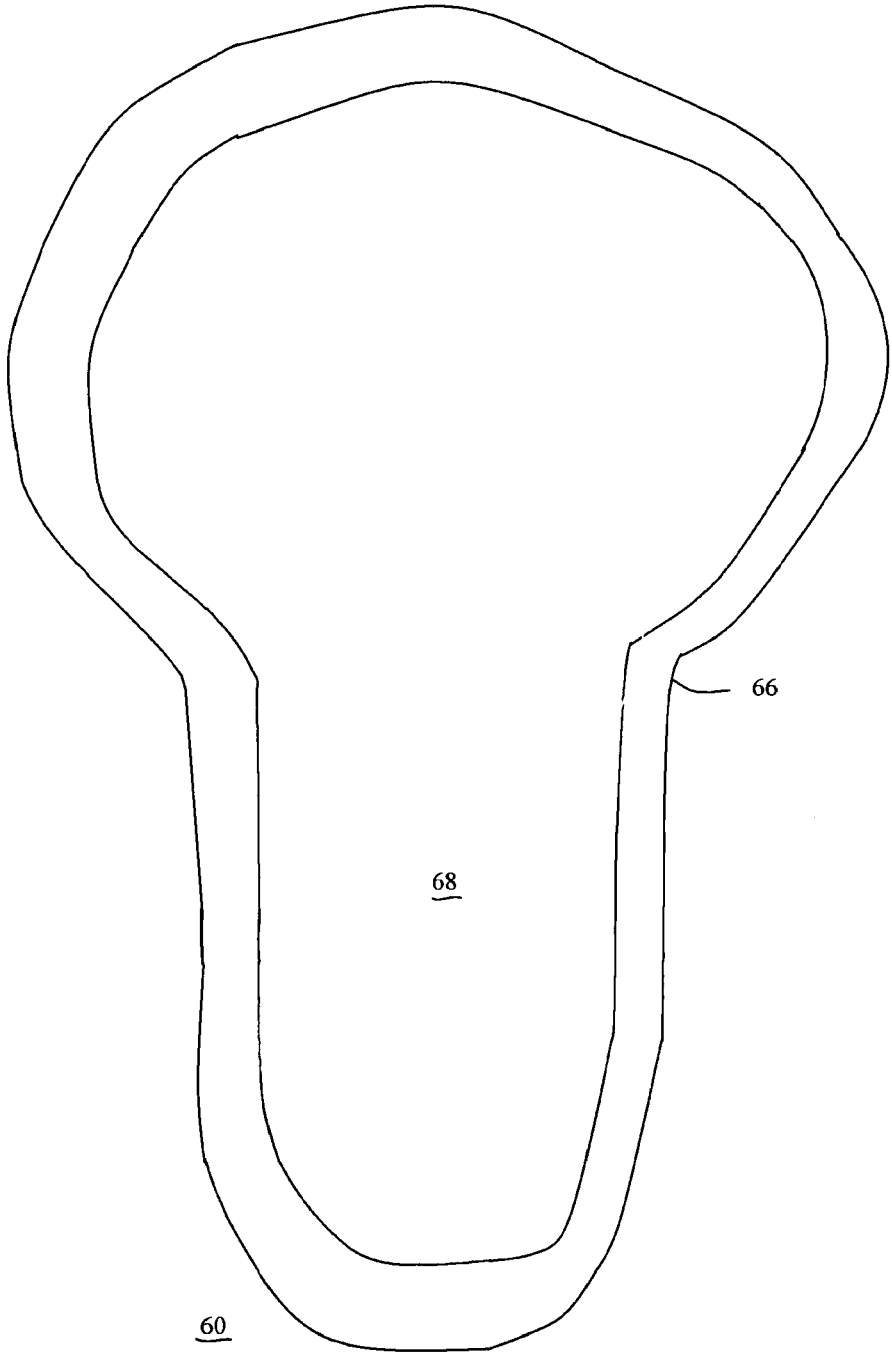
FIG. 5 is a plan view of the package or an element thereof.

So that the shape of the preformed pocket 10 may be maintained during shipping and storage, a package 60 is provided. As shown in FIGS. 4-5, in the preferred embodiment, the package 60 has a male portion 62 and a female portion 64 for sandwiching pocket 10 in its desired shape 34. As a result, the package 60 has a package shape 70 substantially similar to the desired shape 34 of the pocket 10. The package 60 may be provided with tabs 76 to engage the mesh pocket 10 and to be received by grooves 74 to hold the package 60 closed. In the preferred embodiment, tabs 76 are hollow and larger at the intersections with the main portion of the package 60 so that the male portion 62 and the female portion 64 are actually the same packaging thereby allowing many completed packages 60 to be stacked on top on one another for shipping and storage.

After removal from the package 60 and attachment to the head 100, the pocket may need help in maintaining the desired shape 36. Therefore, package 60 is provided with a border 66 that can be removed from a form 68 to be placed into the pocket 10 of the head 10 during non-use.

The manufacture of clamshell packaging is well known in most industries. This method of manufacturing clamshell packaging can be used to make the package 60 as well as the pocket 10. Additionally, it should be understood that package 60 may consist of both male portion 62 and female portion 64 or either.

Figure 6:
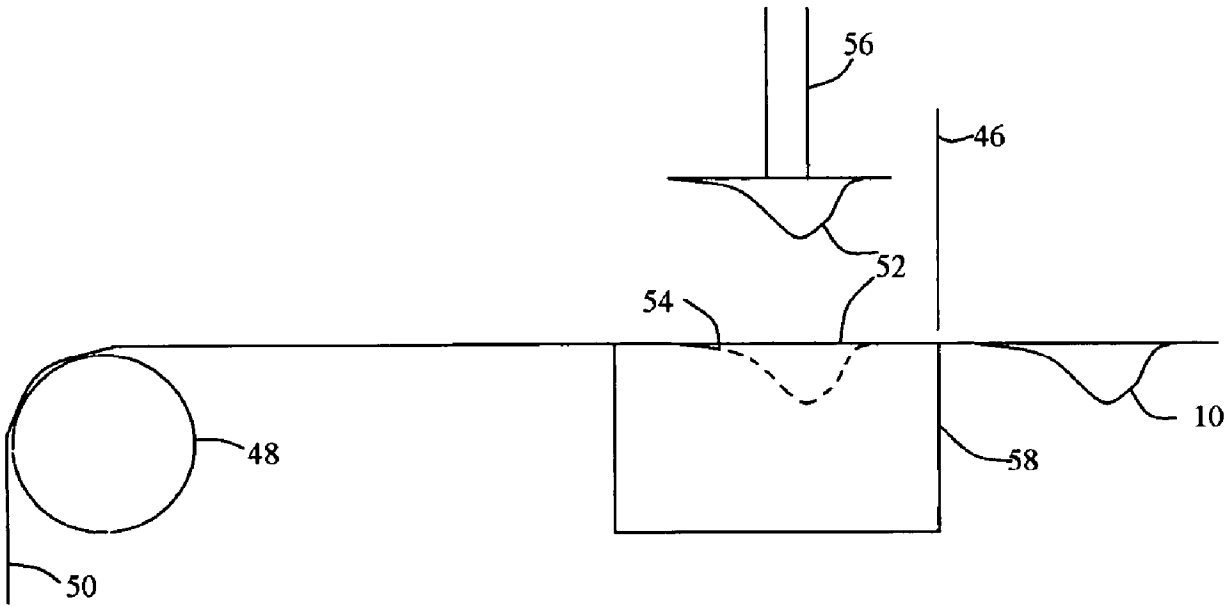
FIG. 6 is a side view of a process for making the pocket of the present invention.

Additionally, FIG. 6 shows one method of manufacturing the preformed pocket 10 of the present invention. A sheet 50 of the mesh material 44 runs over roller 48. The mesh material 44 is then preformed using a mold 52 than may consist of a press or tap 56 and/or a base or die 58. A sheer 46 cuts the sheet 50 either before or after performing. The result is the preformed pocket 10 of the present invention.

Figure 7:
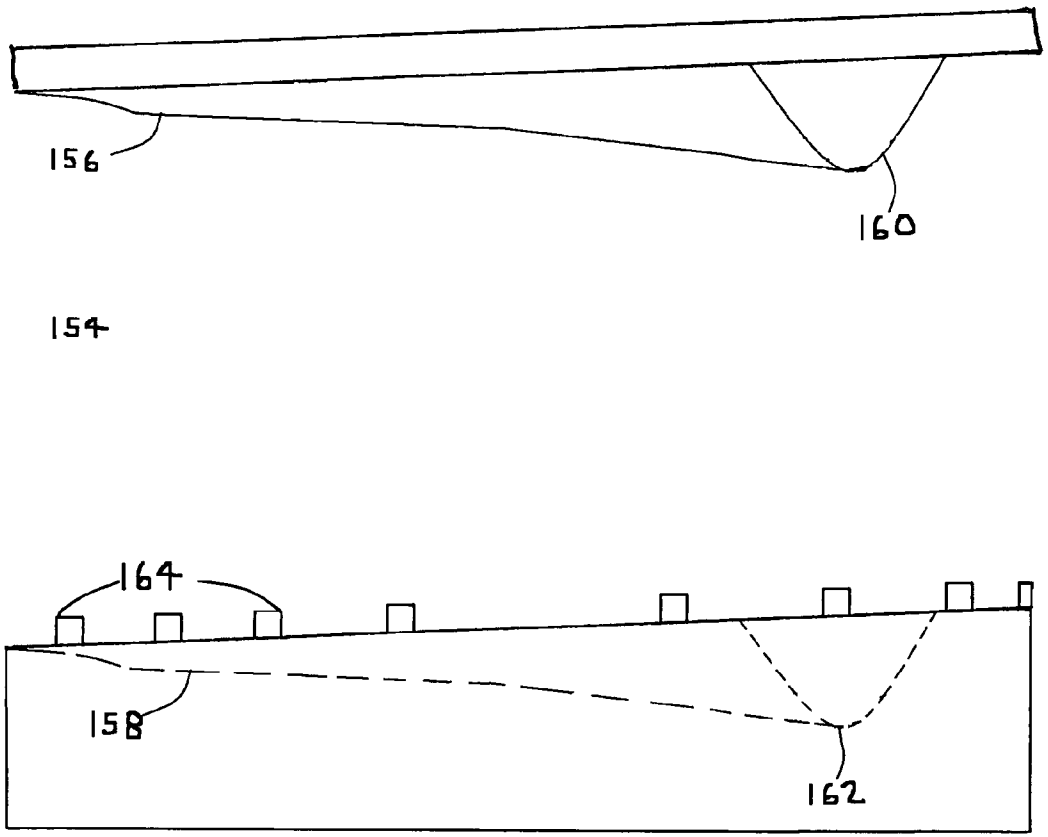
FIG. 7 is a side view of another molding process for creating the pocket of the present invention.

FIG. 7 shows another method of mold the pocket 10 of the present invention. In this embodiment, mold 154 has a male mold portion 156 and a female mold portion 158. The mold portions 156, 158 are shaped to create the desired pocket shape (38 in other figures). Thus, molds are provided with male bulbous portion 160 and female bulbous portion 162. In the preferred embodiment, mesh material in placed over pegs 164 that are shown as part of the female mold portion 162 but can be part of the male mold portion 160 just as easily. Once string over the pegs 164, the male portion 156 is inserted into the female portion 158. In addition to pressure, heat may also be applied to either or both mold portions 156, 158.

Any mesh that may be formed by heat and/or pressure may be used. Additionally, mesh with a higher plastic content is preferred because it is easier to form and it maintains it shape better over time.

Thus, although there have been described particular embodiments of the present invention of a new and useful Preformed Lacrosse Pocket, it is not intended that such references be construed as limitations upon the scope of this invention except as set forth in the following claims.

What is claimed is:

1. A method for manufacturing and packaging a preformed lacrosse pocket for a lacrosse head, the method comprising the steps of:

a) proving a mesh material with a desired shape, the desired shape formed as a lacrosse pocket for a lacrosse head and having a leading edge, a trailing edge, first and second side edges, and preformed depth;

b) placing the formed mesh lacrosse pocket into a package having a package shape substantially similar to the desired shape, the package including a male portion, a female portion and a plurality of tabs;

c) extending the leading edge over one of the tabs, the first side edge over a second one of the tabs, and the second side edge over a third one of the tabs;

d) attaching the male portion to the female portion, the formed mesh lacrosse pocket being positioned between the male portion and the female portion; and e) maintaining the mesh material in the desired non-flat shape formed as a lacrosse pocket for a lacrosse head in step a) by completing steps b), c) and d).

2. The method of claim 1, wherein step a) further comprises heating the mesh material while the mesh material is over the mold to create the desired shape.

3. The method of claim 1, wherein step a) further comprises applying heat to the mesh material by the mold while the mesh material is over the mold to create the desired shape.

4. The method of claim 3 wherein the step of applying the heat to the mesh material sets the desired shape as a lacrosse pocket.

5. The method of claim 1 wherein the desired shape is bulbous toward an end of the mesh material.

6. The method of claim 1 further comprising cutting the mesh material to a size and shape for use in a lacrosse head.

7. The method of claim 1 wherein step a) further includes forming a channel from the trailing edge toward the leading edge of the mesh material.

8. The method of claim 1 wherein step a) further includes forming a bulbous area between the trailing edge and the leading edge of the mesh material.

9. The method of claim 8 wherein step a) further includes forming a channel from the trailing edge to the bulbous area of the mesh material.

10. The method of claim 8 wherein the bulbous area is formed closer to the leading edge than the trailing edge.

11. The method of claim 10 wherein the preformed depth is formed with a variable depth between the trailing edge and the leading edge and the largest depth is proximate the bulbous area.

12. The method of claim 1 wherein the preformed depth is formed with a variable depth between the trailing edge and the leading edge.

13. The method of claim 1 wherein step a) further includes forming the desired shape with a preformed width, the preformed width varying along the length of the side edges.

14. The method of claim 13 wherein the preformed width is formed with the largest width closer to the leading edge than the trailing edge.

15. A method for manufacturing and packaging a preformed lacrosse pocket for a lacrosse head, the method comprising the steps of:

a) proving a mesh material with a desired shape, the desired shape formed as a lacrosse pocket for a lacrosse head and having a leading edge, a trailing edge, first and second side edges, and preformed depth and heating the mesh material while the mesh material is over a mold to create the desired shape;

b) placing the formed mesh lacrosse pocket into a package having a package shape substantially similar to the desired shape, the package including a male portion, a female portion and a plurality of tabs;

c) extending the leading edge over one of the tabs, the first side edge over a second one of the tabs, and the second side edge over a third one of the tabs;

d) attaching the male portion to the female portion, the formed mesh lacrosse pocket being positioned between the male portion and the female portion; and e) maintaining the mesh material in the desired shape formed as a lacrosse pocket for a lacrosse head in step a) by completing steps b), c) and d).

16. The method of claim 15, wherein step a) further comprises applying heat to the mesh material by the mold while the mesh material is over the mold to create the desired shape.

17. The method of claim 16 wherein the step of applying the heat to the mesh material sets the desired shape as a lacrosse pocket.

* * * * *